US007439212B2

(12) United States Patent
King et al.

(10) Patent No.: US 7,439,212 B2
(45) Date of Patent: Oct. 21, 2008

(54) SOYBEAN OIL BASED METALWORKING FLUIDS

(75) Inventors: James P. King, Lansdale, PA (US); Neil Canter, Willow Grove, PA (US)

(73) Assignee: United Soybean Board, St. Louis, MO (US)

( * ) Notice: Subject to any disclaimer, the term of this patent is extended or adjusted under 35 U.S.C. 154(b) by 264 days.

(21) Appl. No.: 10/486,494

(22) PCT Filed: Aug. 13, 2002

(86) PCT No.: PCT/US02/25514

§ 371 (c)(1),
(2), (4) Date: Feb. 11, 2004

(87) PCT Pub. No.: WO03/020855

PCT Pub. Date: Mar. 13, 2003

(65) Prior Publication Data

US 2004/0214734 A1 Oct. 28, 2004

Related U.S. Application Data

(60) Provisional application No. 60/316,971, filed on Sep. 5, 2001.

(51) Int. Cl.
*C10M 169/04* (2006.01)
*C10M 137/04* (2006.01)

(52) U.S. Cl. ..... 508/491; 508/437

(58) Field of Classification Search ..... 508/437, 508/491

See application file for complete search history.

(56) References Cited

U.S. PATENT DOCUMENTS

| | | | |
|---|---|---|---|
| 2,882,228 | A | 4/1959 | Watson et al. |
| 3,791,975 | A | 2/1974 | Halkias |
| 3,963,692 | A | 6/1976 | Ivey, Jr. |
| 4,132,662 | A | 1/1979 | Sturwold |
| 4,134,845 | A | 1/1979 | Wakim |

(Continued)

OTHER PUBLICATIONS http://www/westerndynamics.comDownload/kinviscliquids.pdf for kinematic viscosities of vegetable oils.*

(Continued)

*Primary Examiner*—Glenn Caldarola
*Assistant Examiner*—Jim Goloboy
(74) *Attorney, Agent, or Firm*—Venable LLP; Michael A. Gollin

(57) ABSTRACT

The inventive composition comprises compatible combinations of vegetable oils and polar non-chlorine phosphorous-based extreme pressure additives, the composition being either (a) a working strength straight oil, (b) a soluble oil concentrate dilutable to a working strength soluble oil, the composition when at working strength effectively lubricating metal parts during high performance metalworking, and providing environmental and safety advantages.

40 Claims, 2 Drawing Sheets

| | SOYBEAN OIL | METHYL SOYATE | MINERAL OIL |
|---|---|---|---|
| B.P. | > 300 °C | 200 - 300 °C | 300 - 500 °C |
| M.wt. | ~ 900 | ~ 300 | 225 TO 700[+] |

U.S. PATENT DOCUMENTS

| | | | | | |
|---|---|---|---|---|---|
| 4,138,348 | A | | 2/1979 | Grasshoff | |
| 4,149,982 | A | | 4/1979 | Lee et al. | |
| 4,152,278 | A | * | 5/1979 | Bell | 508/344 |
| 4,225,456 | A | * | 9/1980 | Schmidt et al. | 516/121 |
| 4,359,393 | A | | 11/1982 | Sturwold | |
| 4,374,168 | A | | 2/1983 | Wojtowicz | |
| 4,466,909 | A | * | 8/1984 | Stayner | 508/376 |
| 4,612,127 | A | * | 9/1986 | Uematsu et al. | 508/162 |
| 4,637,885 | A | | 1/1987 | Kuwamoto et al. | |
| 4,769,178 | A | | 9/1988 | Kenmochi et al. | |
| 4,844,830 | A | | 7/1989 | Budd et al. | |
| 4,885,104 | A | | 12/1989 | Sturwold | |
| 4,923,625 | A | | 5/1990 | King | |
| 4,948,521 | A | | 8/1990 | Stewart, Jr. et al. | |
| 5,126,064 | A | * | 6/1992 | Barber et al. | 508/287 |
| 5,236,606 | A | | 8/1993 | Rangel | |
| 5,241,003 | A | * | 8/1993 | Degonia et al. | 525/123 |
| 5,275,749 | A | | 1/1994 | Kugel et al. | |
| 5,320,764 | A | | 6/1994 | Camenzind et al. | |
| 5,507,961 | A | | 4/1996 | Forster et al. | |
| 5,552,068 | A | | 9/1996 | Griffith | |
| 5,573,696 | A | | 11/1996 | Hughes et al. | |
| 5,618,779 | A | | 4/1997 | Klein et al. | |
| 5,627,147 | A | * | 5/1997 | Hayakawa et al. | 508/501 |
| 5,641,734 | A | | 6/1997 | Naegely | |
| 5,652,201 | A | * | 7/1997 | Papay et al. | 508/228 |
| 5,688,749 | A | | 11/1997 | Ibuki et al. | |
| 5,710,112 | A | * | 1/1998 | Yaegashi et al. | 508/159 |
| 5,716,917 | A | | 2/1998 | Williams et al. | |
| 5,721,199 | A | * | 2/1998 | Moses | 508/183 |
| 5,736,493 | A | | 4/1998 | Garmier | |
| 5,780,397 | A | | 7/1998 | Landis et al. | |
| 5,780,400 | A | | 7/1998 | MacNeil et al. | |
| 5,792,731 | A | | 8/1998 | Ichihashi et al. | |
| 5,858,934 | A | | 1/1999 | Wiggins et al. | |
| 5,863,872 | A | | 1/1999 | Garmier | |
| 5,877,131 | A | | 3/1999 | Barnes | |
| 5,908,816 | A | | 6/1999 | Kobessho et al. | |
| 5,916,854 | A | | 6/1999 | Inaya et al. | |
| 5,939,366 | A | | 8/1999 | MacNeil et al. | |
| 5,958,849 | A | | 9/1999 | Hewson et al. | |
| 5,985,806 | A | | 11/1999 | O'Lenick, Jr. | |
| 5,990,055 | A | | 11/1999 | Garmier | |
| 5,994,279 | A | | 11/1999 | Felsky et al. | |
| 6,004,914 | A | | 12/1999 | Perella et al. | |
| 6,010,985 | A | | 1/2000 | Heimann et al. | |
| 6,028,038 | A | | 2/2000 | Kusch | |
| 6,051,538 | A | | 4/2000 | Majerczak | |
| 6,063,741 | A | | 5/2000 | Naitoh et al. | |
| 6,096,699 | A | | 8/2000 | Bergemann et al. | |
| 6,127,326 | A | | 10/2000 | Dieckmann et al. | |
| 6,204,225 | B1 | * | 3/2001 | Lightcap, Jr. | 508/178 |
| 2001/0056045 | A1 | | 12/2001 | Lal | |
| 2002/0016266 | A1 | | 2/2002 | Fletschinger et al. | |

OTHER PUBLICATIONS

Internet Archive Elco Corporation Metalworking additives, Elco 670. <web.archive.org/web/2001063010514/www.elcocorp.com/products/Elco670.html> retrieved from the web on Apr. 9, 2007.*

J.A. O'Brien, "Lubricating Oil Additives", CRC Handbook of Lubrication, vol. II; pp. 301-315.

William C. Gergel, "Lubricant Additive Chemistry", 1984- The Lubrizol Corporation, pp. 1-21.

Soy Methyl Ester Solvents Technical Background, 2 pages.

Office Action mailed Jul. 9, 2008, issued in related U.S. Appl. No. 10/486,493.

* cited by examiner

SOYBEAN OIL BASED METALWORKING FLUIDS

This application is a National Stage of PCT/US02/25514 filed on Aug. 13, 2002, which claims the benefit of provisional application U.S. Ser. No. 60/316,971, filed Sep. 5, 2001, incorporated herein by reference.

BACKGROUND OF THE INVENTION

This invention relates to a metalworking fluid that has lubricating and extreme pressure/anti-wear properties and is environmentally safe, biodegradable, and non-hazardous, comprising a vegetable oil such as soybean oil combined with a polar phosphorous-based extreme pressure additive.

Soybean oil and other vegetable oil triglycerides are known lubricants, but present problems as metalworking fluids, including gumming and residue formation. Lightcap, U.S. Pat. No. 6,204,225. Modified oils can impart improved properties but can complicate processing and add expense. Biodegradable triglyceride-based lubricants are described in e.g. Stewart et al., U.S. Pat. No. 4,948,521 and Naegely, U.S. Pat. No. 5,641,734. Oil lubricating additives are also known, e.g. O'Brien, J. A., *Lubricating Oil Additives*, Handbook of Lubrication, p. 301-315, Vol. II, Edited by E. Richard Booser, CRC Press, Inc., 1984; Gergel, W. C., *Lubricant Additive Chemistry*, The International Symposium Technical Organic Additives—and Environment, Interlaken, Switzerland, May 24-25, 1984, The Lubrizol Corporation. Conventional mineral oil based fluids with chlorine-free sulfur-based extreme pressure agents are described in U.S. Pat. No. 5,908,816.

Most traditional metalworking fluids are based on mineral oils that present potential environmental hazards. These formulations have been widely used for about thirty years. The most difficult metalworking applications (such as fine-blanking heavy gauge carbon steels, broaching, and drawing of stainless steel tubes and wires) require high performance metalworking fluids containing chlorinated paraffins. Recently however, the use of chlorinated paraffins has been questioned due to hazards to workers and the environment. The corrosiveness of chlorinated paraffins' decomposition products, primarily hydrogen chloride, is a concern. A more serious problem is presented at incineration facilities where incineration temperatures are not high enough, producing highly toxic and cancer-causing waste products. Previous attempts to use non-chlorinated replacements have failed in metalworking requiring high performance lubricating and extreme pressure/anti-wear properties.

There is a need for a high performance, economical, environmentally safe metalworking fluid. There is a growing need for effective, biodegradable soy-based straight oil and soluble oil metalworking fluids. For example, Section 9002 of the 2002 Farm Bill mandates federal procurement of biobased products. However, no existing preparations have been able to effectively replace chlorine-containing mineral oil-based metalworking fluids. There is no known metalworking fluid based on a vegetable oil with a phosphorous-based extreme-pressure additive.

SUMMARY OF THE INVENTION

Methyl esters of triglycerides such as methyl soyate provide a desirable base fluid for a high performance metalworking fluid, as described in commonly-owned patent application entitled "Soy-based methyl ester high performance metalworking fluids" filed Aug. 14, 2001, incorporated herein by reference. A vegetable oil such as soybean oil can be used instead or in addition to a methyl ester, in combination with a polar non-chlorine extreme pressure additive. The use of an unmodified vegetable oil reduces cost. However, the use of a triglyceride vegetable oil impairs performance relative to methyl esters of fatty acids. Accordingly, in this invention it is necessary to select a compatible non-chlorine polar extreme pressure additive. In particular, the EP additive is preferably a phosphorous based additive, that is sterically small enough to interact with the metal surface of a workpiece together with the triglyceride (which is larger than a methyl ester). This requirement of a small EP additive is surprising and provides unexpected advantages as demonstrated in the data for various soybean oil-based lubricants.

The inventive composition comprises novel mixtures of vegetable oil triglycerides such as soybean oil and polar non-chlorine extreme pressure additives, the composition being either (a) a working strength straight oil, (b) a pre-emulsion soluble oil concentrate dilutable to a working strength soluble oil, or (c) a soluble oil emulsion diluted to working strength with a diluent, the components working together so that the composition when at working strength effectively lubricates metal parts during metalworking.

The inventive composition is environmentally responsible, biodegradable, non-hazardous, and provides a high performance metalworking fluid with lubricating properties and anti-wear/extreme pressure properties. This invention provides a surprisingly effective combination of a triglyceride, such as soybean oil, and a highly polar non-chlorine extreme pressure additive that provides lubricating performance comparable to mineral oil/chlorinated paraffins-based metalworking fluids.

The composition may require a thickener for high viscosity, such as blown seed oils, blown fats, telemers derived from triglycerides, high molecular weight complex esters, polyalkymethacrylates, polymethacrylate copolymers, styrene-butadiene rubber, malan-styrene copolymers, polyisobutylene, and ethylene-propylene copolymers. For stability, the composition may also require a coupling agent or surfactants, such as polyethylene glycol esters, glyceryl oleates, sorbitan oleates, and fatty alkanol amides. To reduce varnish, gum and sludge formation, addition of antioxidants and dispersants, such as hindered phenols, aromatic amines and succinimides may be required. For soluble oil formulations, which may further include water, mineral oil or solubilizing agents, the composition may also require anti-bacterial and anti-fungal compounds to increase bioresistance. The inventive compositions have good residency time, film strength, load carrying capacity, and good compatibility of the components (vegetable oil/polar non-chlorine extreme pressure additive system plus optional thickeners etc.).

The present invention relates to a composition comprising: a vegetable oil and a polar non-chlorine extreme pressure additive, wherein the composition is either (a) a working strength straight oil, (b) a soluble oil concentrate dilutable to a working strength soluble oil, or (c) a soluble oil diluted to working strength with a diluent, the composition when at working strength effectively lubricating metal parts during metalworking and providing environmental and safety advantages. In one embodiment of the invention, there is no mineral oil or added water.

This composition, at working strength, effectively lubricates metal parts under conditions of high temperature, high load, high torque, high friction and/or high speed. It can be a high performance fluid with lubricating properties in a four-ball EP LWI test of at least about 40, preferably at least about 130, and extreme anti-wear/extreme pressure properties of a four-ball EP weld point of at least about 315 kg preferably at least about 620 kg. The composition can also impart a four-ball EP weld point of at least about 800 kg. In addition, it can be lubricious at Falex EP (ASTM D3233) of at least about 4500 lbs. and over.

The vegetable oil can be selected from the group consisting of soybean oil, rapeseed (canola) oil, or sunflower oil, and may be coconut oil, peanut oil, crambe oil, and combinations, or even comprise animal fats such as lard or tallow. Soybean oil is preferred.

The polar non-chlorine extreme pressure additive is small and is preferably a phosphorus-based derivative. The polar non-chlorine extreme pressure additive is preferably selected from alkylamines or alkanolamine salts of phosphoric acid, amine phosphates, propanolamine phosphates, butylamine phosphates, phosphate esters, and organophosphites, and combinations. In another aspect, the polar non-chlorine extreme pressure additive is Desilube™ 77 (Desilube, Inc.), a mixture of organic amine salts of phosphoric and fatty acids.

In another embodiment of the invention, the composition can further comprise a thickener. A preferred viscosity can be at 40° C. is at least about 30 cSt. This thickener can be selected from the group consisting of blown seed oils, blown fats, telemers derived from triglycerides, high molecular weight complex esters, polymeric ester, blown castor oil, polyalkymethacrylates, polymethacrylate copolymers, styrene butadiene rubber, ester-styrene copolymers, polyisobutylene, ethylene-propylene copolymers and combinations. The thickener can also be G.Pfau Blown Castor Oil Z8, Inolex GC5000 (a comolex ester), Roh-Max Viscoplex 8-702 (which includes polyakylmethacrylate), Lubrizol 7785 (which includes polyakylmethacrylate) or Lubrizol 3702 (which includes styrene copolymer). This thickener permits the composition to have residency time as expressed by kinematic viscosity of at least about 100 cSt at 40° C., film strength as measured by four-ball initial seizure load of at least about 120 kg, load carrying capacity as measured by four-ball load wear index of at least about 130, and compatibility between the triglyceride and the polar non-chlorine extreme pressure additive.

In yet another embodiment of the invention, the composition further comprises a stabilizing coupling agent and/or surfactant. The coupling agent and/or surfactant is selected from the group consisting of propylene glycol, polyethylene glycol esters, glyceryl oleates, glyceryl monooleate, sorbitan oleates, fatty alkanol amides and combinations. In yet a further aspect, the composition further comprises an antioxidant and/or dispersant. The antioxidant and/or dispersant is selected from the group consisting of hindered phenols, aromatic amines, succinimides and combinations. The antioxidant and/or dispersant can also be selected from the group consisting of Lubrizol 7652 by Lubrizol Corporation, Irganox L109 (which includes a high molecular weight phonolic antioxidant)or Irganox L57 (which includes an octlyated/butylated diphenylamine) by Ciba Corporation. The dispersant can be HiTec 646 by Ethyl Corporation.

In one aspect of the invention, the composition comprises from about 20% to about 95% vegetable oil, from about 3% to about 25% polar non-chlorine extreme pressure additive, up to about 50% thickener, up to about 10% coupling agent and/or surfactant, and up to about 25% antioxidant and/or dispersant. In another aspect, the composition comprising from about 45% to about 90% vegetable oil, about 5% to about 15% polar non-chlorine extreme pressure additive, and about 5% to about 7.5% glyceryl monooleate. The ratio of the vegetable oil to the polar non-chlorine extreme pressure additive can be from about 50:1 to about 1:2.

This invention further relates to a method of using a composition of the invention for lubricating purposes comprising applying the composition to metal parts during metalworking.

Yet a further embodiment of this invention also relates to a composition being concentrated soluble oil. The composition can comprise from about 5% to about 90% vegetable oil, about 3% to about 20% polar non-chlorine extreme pressure additive, and up to about 10% water.

The composition can also comprise from about 5% to about 90% vegetable oil, about 1% to about 20% polar non-chlorine extreme pressure additive, about 10% to about 50% emulsifiers, up to about 10% antioxidants, about 1% to about 10% biocides, about 5% to about 40% corrosion inhibitors, up to about 10% coupling agents, up to about 10% defoamers, up to about 10% water and up to about 90% mineral oil.

The composition may also comprise methyl soyate or another methyl ester of a triglyceride to improve metalworking performance. According to the invention, however, the less expensive more commonly available commodity vegetable oil is used as at least a major component of the formulation. In one aspect of this embodiment, the methyl ester is a methyl soyate.

The ratio of the vegetable oil to the polar non-chlorine extreme pressure additive can be from about 1:2 to about 50:1. The ratio of the vegetable oil to the polar non-chlorine extreme pressure additive can also be from about 2:1 to about 30:1.

This embodiment can further comprise up to about 90% mineral oil. In this aspect of the invention, the composition can comprise from about 5% to about 90% vegetable oil, about 20% to about 35% polar non-chlorine extreme pressure additive, and about 5% to about 90% mineral oil. The composition can further comprise from about 5% to about 90% triglyceride optionally including a methyl ester of a triglyceride, about 1% to about 20% polar non-chlorine extreme pressure additive, about 10% to about 50% emulsifiers, up to about 10% antioxidants, about 1% to about 10% biocides, about 5% to about 40% corrosion inhibitors, up to about 10% coupling agents, up to about 10% defoamers, up to about 10% water and up to about 90% mineral oil.

In yet a further aspect, the composition is a mixture of the vegetable oil, the polar non-chlorine extreme pressure additive and mineral oil in a ratio of about 1:2:6. It can also comprise a mixture of the vegetable oil, the polar non-chlorine extreme pressure additive and mineral oil in a ratio about of 9:1:0.

In yet a further aspect, the composition comprises an anti-bacterial and/or anti-fungal compound effective to prevent bacterial and fungal formation. The composition can be from about 5% to about 90% vegetable oil, about 3% to about 20% polar non-chlorine extreme pressure additive, up to about 10% water, up to about 10% coupling agents, 5% to 40% corrosion inhibitors, up to about 10% biocides, about 10% to 50% emulsifiers, up to about 6% antioxidants and up to about 5% defoamers.

In yet another embodiment, the invention relates to a method of making a soluble oil composition, comprising: (a) combining a vegetable oil with an extreme pressure non-chlorinated additive to form a soluble oil concentrate, and (b) diluting the concentrate to working strength with water. This can further comprise adding a coupling agent for increasing stability, a corrosion inhibitor, an emulsifier, an anti-bacterial and/or anti-fungal compound effective to reduce bacterial and fungal formation.

The soluble oil of this invention can comprise at least about 50%, 75% or 95% of a diluent. The diluent can be water. The soluble oil can comprise from about 5% to about 50% vegetable oil, and about 5% to about 20% polar non-chlorine extreme pressure additive, the ratio of vegetable oil to polar non-chlorine extreme pressure additive being in the range of about 1:1 up to about 50:1, preferably up to about 20:1 or up to about 10:1.

This oil can further comprise a soluble oil conditioner selected from a group consisting of a coupling agent for increasing stability, a corrosion inhibitor, an emulsifier, an anti-bacterial, anti-fungal compound, and combinations. The composition can comprise from about 5% to about 90% vegetable oil, about 3% to about 20% polar non-chlorine extreme pressure additive, about 10% to about 50% emulsifiers, up to about 10% antioxidants, about 1% to about 10% biocides, about 5% to about 40% corrosion inhibitors, up to about 10% coupling agents, up to about 10% defoamers, up to about 10% water and up to about 90% mineral oil.

The invention provides a metalworking fluid for lubricating a metal surface, comprising: a base fluid compound having polar end groups and non-polar hydrocarbon chains (C5-C22) and a boiling point in the range of about 200' to about 300° C., and a polar non-chlorine extreme pressure additive, during metalworking, the base fluid compound lubricating the metal surface at temperatures below the boiling point, and removing heat away from the metal surface at the boiling point, the extreme pressure additive increasing in concentration, and reacting chemically with the metal surface as the temperature exceeds the boiling point of the base fluid, the metalworking fluid effectively lubricating the metal surface during metalworking so as to prevent failure at temperatures below, at, and above the boiling point of the base fluid.

The inventive compositions have metalworking performance at least equivalent to a mineral oil based chlorinated paraffin metalworking fluid.

In all such compositions, the vegetable oil is preferably soybean oil.

Further objectives and advantages will become apparent from a consideration of the description, drawings, and examples.

BRIEF DESCRIPTION OF THE DRAWINGS

The invention is better understood by reading the following detailed description with reference to the accompanying figures, in which like references refer to like elements throughout, and in which.

DETAILED DESCRIPTION OF THE PREFERRED EMBODIMENTS

Figure 1:
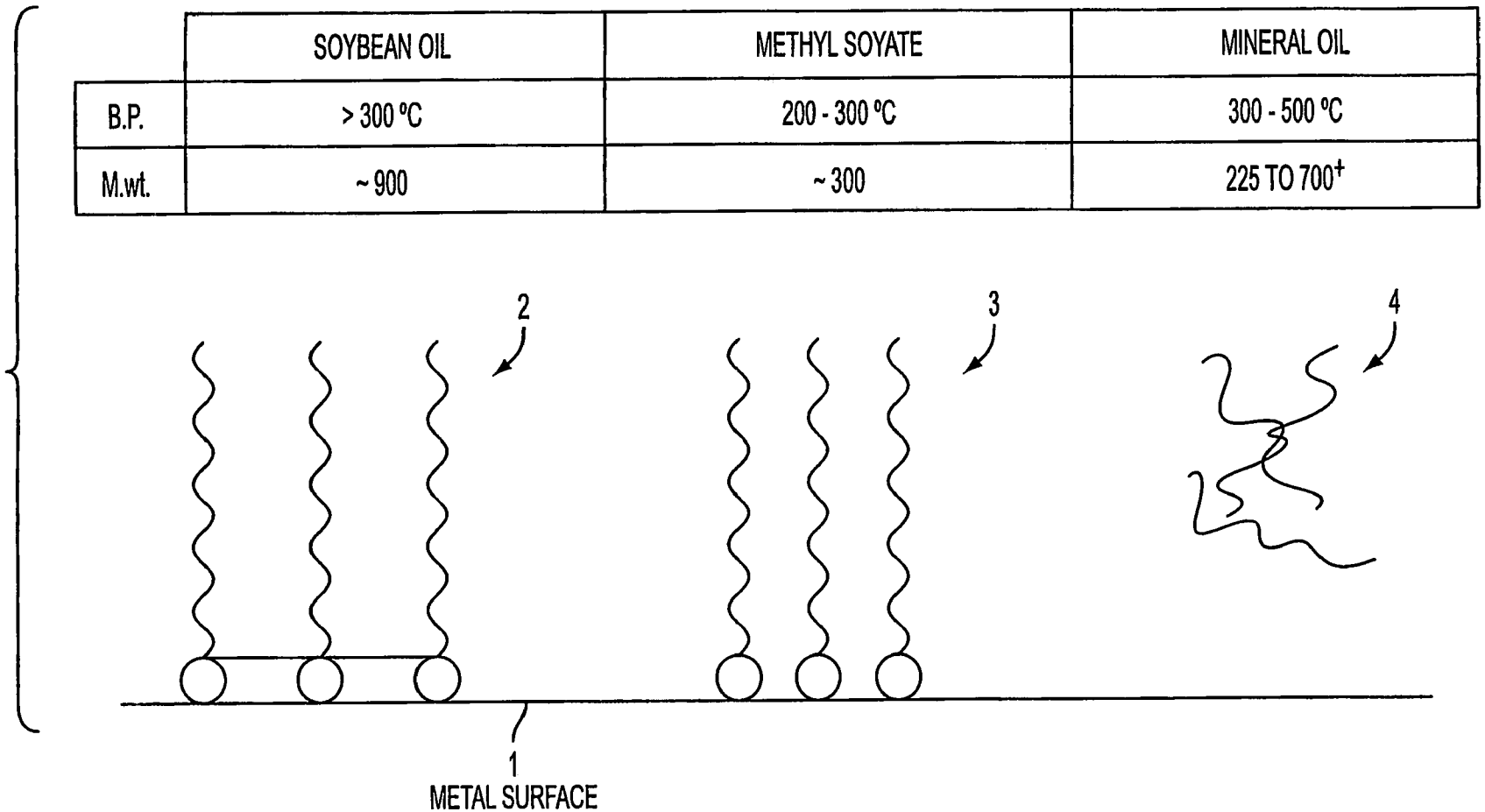
FIG. 1 illustrates comparative properties of soybean oil (bp>300° C., MW ~900), methyl soyate (bp 200-300° C., MW ~300), and mineral oil (bp 300-500° C., MW 225-700+).

In describing preferred embodiments of the present invention, specific terminology is employed for the sake of clarity. However, the invention is not intended to be limited to the specific terminology so selected. It is to be understood that each specific element includes all technical equivalents, which operate in a similar manner to accomplish a similar purpose. Each reference cited here is incorporated by reference as if each were individually incorporated by reference.

The invention provides fluids based on natural oils such as soybean oil, for heavy-duty metalworking applications. Preferred compositions based on vegetable oils combined with a polar non-chlorine extreme pressure (EP) additive have unique characteristics. The combination exhibits outstanding extreme pressure/anti-wear properties that are far superior to existing mineral oil-based counterparts. Inventive compositions containing vegetable oils or triglycerides and a polar non-chlorine extreme pressure additive combination successfully replaced chlorinated paraffin-mineral oil-based fluids containing up to about 15% and 35% chlorine.

Generally, the present invention utilizes vegetable oil or triglycerides ($C_5$-$C_{22}$) derived from vegetable seeds or animal fats. These natural oils typically contain $C_{16}$ palmitic acid, and $C_{18}$ stearic, oleic, linoleic, and linolenic. The composition may be composed of from about 20% to 95% soybean oil. Preferably the oil is in the amount of up to or about 30, 40, 50, 55, 60, 65, 75, 80, 85 or 90% of the composition. More preferably the soybean oil is in the amount up to or about 90% of the composition.

In addition to the vegetable oils, to produce a heavy-duty, chlorinated paraffin replacement metalworking fluid, one or more extreme pressure additives are required. In particular, the present invention is directed toward the combination of a vegetable oil and a polar non-chlorine extreme pressure (EP) additive, preferably one that is environmentally responsible, e.g. a phosphorus-based amine phosphate, such as phosphate esters, organophosphites, and alkylamine or alkanolamine salts of phosphoric acid. The combination of these two components provides superior extreme pressure performance, which is seldom observed among conventional base fluid EP blends. The novel formulations provide surprising and unexpected performance characteristics superior to existing biodegradable formulations, in that they can impart a four-ball EP weld point (ASTM D 2783) of at least 400, preferably 620 kg, many as high as 800 kg, as demonstrated for inventive products below in Table 1.

High performance metalworking lubricants have many uses in industry. In order to satisfy the specific needs of the ultimate user, it is often necessary for the lubricant to have various performance characteristics. A lubricant's performance characteristics are often measured in terms of four-ball EP LWI (Extreme Pressure Load Wear Index), four-ball Weld Point, four-ball ISL (Initial Seizure Load) and Falex Fail Load. Although each of these characteristics has associated desirable levels, the specific needs of a specific lubricant user may require that no more than one parameter falls within the desirable range.

As used herein, the phrase "four-ball LWI", also known as a measure of load carrying capacity, refers to an index of the ability of a lubricant to prevent wear at applied loads. Under the conditions of this test, specific loadings in kilogram-force, having intervals of approximately 0.1 logarithmic units, are applied by a rotating ball to another three stationary balls for ten runs prior to welding (ASTM D2783). The inventive compositions provide an LWI value of at least about 40. A high performance metalworking lubricant according to the invention is one that has a LWI value of 130 or higher.

As used herein, the phrase "four-ball weld point" refers to the lowest applied load, in kilogram-force, at which the rotating ball seizes and then welds to the three stationary balls. This indicates that the extreme pressure level of the lubricant has been exceeded (ASTM D2783). The test indicates levels stepwise, at 400, 500, 620, 800, and the top value of 800+. A high performance metalworking lubricant as defined here is one that has a weld point of at least 620 kg, preferably 800 kg or exceeding 800 kg (800+).

As used herein, the phrase "four-ball ISL" (initial seizure load) refers to the lowest applied load, in kilogram-force, at which that metal to metal contact between the rotating ball with the three stationary balls occurs. A high performance metalworking lubricant as defined here should have an ISL value of 120 kg or higher. This value is also a measure of the lubricant's film strength.

The Falex Pin and Vee Block test method consists of running a rotating steel journal at 290 plus or minus 10 rpm against two stationary V-blocks immersed in the lubricant sample. Load (pound-force) is applied to the V-blocks by a ratchet mechanism. Increasing load is applied continuously until failure. The fail load value obtained serves to differentiate fluids having low, medium and high level extreme pressure properties. A high performance metalworking lubricant as defined here is one that has a minimum fail load value of 4,000 lbs., preferably 4500 lbs. or exceeding 4500 lbs. This method (ASTM D 3233) is particularly useful for diluted soluble oil samples.

A modified Falex method was developed to detect varnish, gum and sludge formation of a lubricant under stress conditions and to determine dispersing power of the test fluid. This method is similar to the procedure A of the standard Falex EP test (ASTM D 3233) as described above. This modified method requires that the test fluid must have a fail load of 4500 lbs. or higher. Increasing load is applied until reaching 4500 lbs. Load is maintained at 4500 lbs. for 6 minutes. Torque and bulk temperature of the test fluid is measured every 60 seconds. At the end of the test, the test specimens are removed and any varnish, coating or sludge formations around the contact areas are observed. Observations of the used fluids include: clear with deposition of wear debris; homogeneous black dispersion; or black dispersion with deposition of wear debris. A high performance metalworking fluid as defined here should exhibit no or very slight varnish, coating and sludge and it should generate a homogeneous dispersion without noticeable deposition of wear debris in the used fluid.

A real-world field trial is a procedure employed by users who replace the existing commercial metalworking fluid with an experimental one in actual production. Conditions and parameters of each trial are highly individualized to the user's specific equipment and performance situation.

Fine-blanking is a metalworking operation involving a precision, low tolerance, severe cutting/extruding process and a heavy gauge steel stack up to 16 mm in thickness. The contact pressure and temperature between the die and the work piece can reach as high as 200,000 psi and 1,000° C., respectively. This is one of the most difficult metalworking operations known in the industry. Lubricant formulations sufficient for meeting the requirements of this application will also meet the requirements of many other, less demanding applications.

Polarity of an organic compound denotes a shift of electron density within the molecule influenced by the electronegativity of certain elements or groups attached to the compound. As used herein, the phrase "polar non-chlorine extreme pressure additive" refers to any non-chlorine extreme pressure additive that is at least as polar as organophosphites.

As used herein, the phrase "effectively lubricating" refers to how a lubricant, acting between a tool die and a work piece, satisfactorily meets predetermined metalworking performance requirements without causing excessive friction and wear on the die, as judged comparatively by the equipment operator and his quality control criteria.

For high performance metalworking lubricants, as used herein, the phrase "working strength" refers to the concentration at which the lubricant is used—as is for a straight oil lubricant, or with dilution for a soluble oil. The performance is measured at working strength and while a soluble oil is not typically measured by a four-ball test, a soluble oil at working strength after a standard dilution with water (e.g. 1 to 20) should impart a Falex fail load of at least 4000 lbs, preferably 4500 lbs.

A lubricant composition with good stability as used herein refers to a homogenous or clear composition that will not show any sign of separation, change in color or clarity for a sustained period typically at least one and preferably at least three or at least six months. It should be noted that "good stability," while desirable for many applications, is not required for some applications, e.g. "once through" applications, and should not be considered as a limiting factor to this invention. In some circumstances, a relatively unstable formulation could be prepared just prior to use, substantially reducing any stability-over-time issue.

In an exemplary embodiment of the invention, the polar non-chlorine extreme pressure additive is a sulfur- or phosphorus-based derivative or a combination that is polar and sterically small enough to interact with the metal surface of a work piece together with the triglyceride (which is larger than a methyl ester), and preferably one that is environmentally responsible.

The term phosphorous-based polar non-chlorine extreme pressure additive means a phosphorus-based derivative such as phosphorus-based amine phosphates, including alkylamine or alkanolamine salts of phosphoric acid, butylamine phosphates, long chain alkyl amine phosphates, organophosphites, propanolamine phosphates, or other hydrocarbon amine phosphates, including triethanol, monoethanol, dibutyl, dimethyl, and monoisopropanol amine phosphates. The phosphorus-based derivative may be an ester including thioesters or amides of phosphorous containing acids. The organic moiety from which the phosphorous compound is derived may be an alkyl, alcohol, phenol, thiol, thiophenol or amine. The three organic residues of the phosphate compound may be one or more of these or combinations. Alkyl groups with 1 to 4 carbon compounds are suitable. A total carbon content of 2 to 12 carbon atoms is suitable. The phosphorous based compound may be a phosphorous oxide, phosphide, phosphite, phosphate, pyrophosphate and thiophosphate.

The polar non-chlorine extreme pressure additive may be a sulfur-based derivative such as sulfurized fatty esters, sulfurized hydrocarbons, sulfurized triglycerides, alkyl polysulfides and combinations.

The polar non-chlorine extreme pressure additive may be selected from the group consisting of Desilube 77, RheinChemie RC 8000 and RheinChemie RC2540, RheinChemie 2515, RheinChemie 2526, Lubrizol 5340L, Nonyl Polysulfide, Vanlube 672, Rhodia Lubrhophos LL-550, or EICO 670 or combinations.

Of the several sulfur- or phosphorus-based extreme pressure additives that were tested, the relative effectiveness of these additives in methyl soyate (and predictably therefore for soybean oil and other vegetable oils) for many applications can generally be rated as follows: Alkylamine or alkanolamine salts of phosphoric acid>sulfurized triglycerides>>sulfurized hydrocarbons=alkylpolysulfides>organophosphites>phosphate esters. Preferably, the polar non-chlorine extreme pressure additive is an amine phosphate blend, such as the commercially available product, Desilube 77, a mixture of organic amine salts of phosphoric and fatty acids. The composition may be composed of from about 2% to 30% polar non-chlorine extreme pressure additive. Preferably the polar non-chlorine extreme pressure additive is in the amount of up to or about 0.5, 1, 2, 3, 5, 10, 15, or 20% of the composition. The ratio of the vegetable oils or triglycerides to the polar non-chlorine extreme pressure additive is in the range of about 1:1.5 to about 48:1.

Depending on a particular metalworking operation, the required viscosity may vary considerably from one application to another. This invention may cover a broad range of metalworking applications from tapping/penetrating fluid (5-20 cSt at 40° C.) to deep drawing (100 to 2,000 cSt at 40° C.) or broader in some embodiments. The invention may require a thickened version of the composition for certain metalworking operations, which require fluids with a high viscosity. So in one aspect of the invention, the composition may further comprise a high viscosity fluid thickener, such as blown seed oils, blown fats, telemers derived from triglycerides, high molecular weight complex esters, polyalkylmethacrylates, polymethacrylate copolymers, styrene-butadiene rubber, malan-styrene copolymers, polyisobutylene, and ethylene-propylene copolymers. Preferably, blown castor oil (e.g. Peacock Blown Castor Oil Z-8) and a complex ester (e.g. Lexolube CG-5000) are used. Combining the methyl soyate and polar non-chlorine extreme pressure additive with a thickener provides the composition with good residency time, film strength, load carrying capacity, and good compatibility with all the components. Residency time refers to the duration of a fluid applied on a work piece that can stay in place prior to metalworking operation. A fluid with an acceptable residency time for fineblanking is one that has a minimum viscosity of 100 cSt at 40° C. A metalworking fluid with good compatibility of all the components is one that shows no sign of separation or change from clear solution to hazy appearance. The composition may be composed of about up to 50% thickener. Preferably the thickener is in the amount of up to or about 10, 15, 20, 25, 30 or 35% of the composition.

In yet another aspect of the invention, depending on the type of extreme pressure additives used, the composition of vegetable oil and polar non-chlorine extreme pressure additive may further comprise a coupling agent and/or surfactant to improve the stability and compatibility of all the ingredients. Such coupling agents as polyethylene glycol esters, glyceryl oleates, sorbitan oleates, and fatty alkanol amides are generally found to be effective. The composition may be composed of up to about 10% coupling agent and/or surfactant. Preferably the coupling agent and/or surfactant is in the amount of up to or about 1, 2, 3, 5, 7 or 7.5% of the composition.

In another aspect of the invention, the composition may further comprise an antioxidant and/or a dispersant to reduce or effectively avoid varnish, gum and sludge formation. Most of the esters of the vegetable seed oils and animal fats are inferior to mineral oil in oxidative and thermal stability and can be readily decomposed when subjected to highly stressed conditions, leading to heavy varnish, gum and sludge formation. A number of antioxidants and dispersants, such as those which have been used in automobile engine oils, are quite suitable for these purposes. Both hindered phenols and aromatic amines are effective. Succinimides are found to be good dispersants. The composition may be composed of up to about 25% antioxidant and/or dispersant. Preferably the antioxidant and/or dispersant is in the amount of up to or about 1, 3, 5, 7, 10, or 15% of the composition.

In another embodiment of the invention, a soluble oil formulation is provided, as concentrate or diluted fluid. This soluble oil combines the benefits of lubricity of the straight oil with the economics and cooling benefit of water. The soluble oil, containing vegetable oils or triglycerides, polar non-chlorine extreme pressure additive, and water (or soluble agent) can further comprise mineral oil. Here, the basic combination of vegetable oils or triglycerides and polar non-chlorine extreme pressure additive composition further comprises a variety of soluble oil conditioners such as alkanolamines, anionic and nonionic emulsifiers, antioxidants, biocides, corrosion inhibitors, coupling agents, defoamers, mineral oil or water. The vegetable oils or triglycerides is generally in amount of about 5% to about 90% of the composition as a concentrate. The polar non-chlorine extreme pressure additive is generally in an amount of from about 3% to about 50% of the composition. The emulsifiers are generally in an amount of about 10% to 50% of the composition. The antioxidants is in an amount of up to about 10% of the composition. The corrosion inhibitors are in an amount of from about 5% to about 40% of the composition. In a preferred embodiment, the corrosion inhibitors contain a boric acid derivative. The coupling agent is in an amount of up to about 10% of the composition. The defoamers are in an amount of up to about 5% of the composition. The water is in the amount of up to about 10% of the concentrated composition. The mineral oil is in an amount of up to about 90% of the composition.

In yet a further aspect of the invention, an anti-bacterial and/or antifungal compound is used to prevent the formation of fungus or bacteria. In addition, water-based metalworking fluids need to be alkaline in pH to minimize problems such as metal corrosion and the growth of microbials. The desired pH is from about 8.5 to about 10. The soluble oil can be diluted with water to a use dilution between about 2% and about 50% (in a dilution range of about 50:1 to 1:1). When diluted to a use level of 5% (20:1), the pH of the two fluids is in the desired range.

EXAMPLES

For screening lubricating performance, both four-ball EP and Falex pin and V-block testers were employed. Two commercial chlorinated paraffins/mineral oil-based fluids containing 35 and 55% chlorine were obtained and evaluated for references. For real-world field trials, the inventors experimented closely with fine-blanking applications, which produces various steel parts used to supply automobile manufacturers. Three chlorinated paraffin-based metalworking fluids containing 15%, 35%, and 55% chlorine, were replaced with one or more non-chlorine fluids for the field trials. For the soluble oil fluids, chlorinated paraffin based, heavy duty fluids prepared just with mineral oil, with mineral oil and triglyceride and with mineral oil and a triglyceride were used as references.

Screening of Various Extreme Pressure Additives

A number of extreme pressure additives were mixed in methyl soyate. In some cases, coupling agents or surfactants were employed to improve compatibility between the base fluid and the polar non-chlorine extreme pressure additive.

An objective was to replace heavy-duty commercial metalworking fluids containing up to about 55% chlorine, so the concentrations of the extreme pressure additives screened in soybean oil are relatively high. Lower concentrations of polar non-chlorine extreme pressure additives would be sufficient for applications where lower concentrations of chlorine-containing extreme pressure additives are now used. An established criterion is that the concentration of a polar non-chlorine extreme pressure additive should be sufficiently high to provide a minimum value of four-ball weld point of 620 kg on AISI 52100 steel balls. Another criterion is a Four Ball EP LWI of at least 130. Examples and experimental data are recorded in Table 1 (Examples 1-9). Example formulations 1-6 and 9 qualify as high performance metalworking fluids.

The results in Table 1 show the relative performance of various extreme pressure additives. Most of these formulations (Examples 1-6) exhibit a weld point exceeding 800 kg, which is the maximum load that can be applied on a four-ball testing machine. As seen in Table 1, using the four-ball LWI relative performance value, the compositions can be ranked as follows: alkanol and alkylamine salts of phosphoric acid>sulfurized fatty esters>sulfurized hydrocarbons>alkylpolysulfides>organophosphites>phosphate esters.

TABLE 1

Screening of Various Extreme Pressure Additives in Methyl Soyate

| | 1[a] | 2[b] | 3 | 4 | 5 | 6 | 7[a] | 8 | 9 |
|---|---|---|---|---|---|---|---|---|---|
| Methyl Soyate (SoyGold 1000) | 77.5 | 75.0 | 85.0 | 85.0 | 85.0 | 85.0 | 77.5 | 85.0 | 85.0 |
| Amine Phosphates (Desilube 77) | 15.0 | | | | | | | | |
| Propanolamine Phosphate | | 10.0 | | | | | | | |
| Butylamine Phosphate | | | 15.0 | | | | | | |
| Sulfurized Fatty Ester (Additin RC 2515) | | | | 10.0 | | | | | |
| Sulfurized Fatty Ester (Additin RC 2526) | | | | 5.0 | | | | | |
| Sulfurized Hydrocarbon (Lubrizol ™ 5340L) | | | | | 15.0 | | | | |
| Alkyl polysulfide (Nonyl Polysulfide) | | | | | | 15.0 | | | |
| Long Chain Alkyl Amine Phosphate (Vanlube ® 672) | | | | | | | 15.0 | | |
| Phosphate Ester (Lubrhophos/LL-550) | | | | | | | | 15.0 | |
| Organo Phosphite (ELCO 670) | | | | | | | | | 15.0 |
| Four-Ball EP Weld Point | 800+ | 800+ | 800+ | 800+ | 800+ | 800+ | 500 | <500 | 620 |
| Four-Ball EP LWI | 239 | 214 | 190 | 164 | 154 | 150 | 89 | | 130 |

[a]Containing 7.5% glyceryl monooleate as coupling agent
[b]Containing 5% glyceryl monooleate and 10% ethoxylated + tolloamine The components listed in Table 1 are commercially available. Additin RC 2515 by Rhein Chemie Corp., is a sulfurized vegetable fatty ester and hydrocarbon. Additin RC 2526 by Rhein Chemie Corp., is a sulfurized vegetable fatty acid ester, fatty acid and hydrocarbon. Lubrizol™ 5340L by the Lubrizol Corporation, is an olefin sulfide. Vanlube® 672 by R. T. Vanderbilt is a long chain alkylamine phosphate. ANTARA LL-550 (Lubrhophos) by Rhone-Poulenc is a free acid form of a complex organic phosphate ester. ELCO-670 by the ELCO Corporation is an alkyl phosphite alkanolamine ester polymer.

Comparative EP Performance of Methyl Soyate, Soybean Oil, and Mineral Oil

Among various base fluid/polar non-chlorine extreme pressure additive combinations, the performance of methyl soyate/extreme pressure additive systems stand out in comparison with those of mineral and soybean oil formulations (see results in Table 2 below). The lubricating properties of the methyl soyate and polar non-chlorine extreme pressure additive combination are compared with other fluids, wherein five extreme pressure additives are compared in three base fluids—methyl soyate, soybean oil, and mineral oil.

The experimental results are recorded in Table 2 (Examples 10-20). Based on the four-ball weld point and LWI results, the combinations of soybean oil and polar non-chlorine extreme pressure additives (Examples 12, 15, and 18) consistently outperform the mineral oil counterparts (Examples 11, 14, and 20). The most preferred formulation is Example 12. Soybean oil with organophosphite (Example 18) outperformed methyl soyate with the same relatively low polarity polar EP additive (Example 16).

TABLE 2

Comparative EP Performance of Selected EP Additives in Methyl Soyate, Mineral Oil, and Soybean Oil

| | Composition (%) | | | | | | | | | | |
|---|---|---|---|---|---|---|---|---|---|---|---|
| | 10a | 11a, c | 12b | 13 | 14 | 15b | 16 | 17 | 18 | 19 | 20 |
| Methyl Soyate (SoyGold 1000) | 77.5 | | | 85.0 | | | 85.0 | | | 85.0 | |

TABLE 2-continued

Comparative EP Performance of Selected EP Additives in Methyl Soyate, Mineral Oil, and Soybean Oil

| | Composition (%) | | | | | | | | | | |
|---|---|---|---|---|---|---|---|---|---|---|---|
| | 10a | 11a, c | 12b | 13 | 14 | 15b | 16 | 17 | 18 | 19 | 20 |
| Paraffinic Mineral Oil (200 SUS) | | 72.5 | | | 85.0 | | | 85.0 | | | 85.0 |
| Soybean Oil (IV: 120) | | | 80.0 | | | 80.0 | | | 85.0 | | |
| Amine Phosphate Blend (Desilube 77) | 15.0 | 15.0 | 15.0 | | | | | | | | |
| Organophosphite (ELCO 670) | | | | | | | 15.0 | 15.0 | 15.0 | | |
| Sulfurized Hydrocarbon (Lubrizol 5340L) | | | | 15.0 | 15.0 | 15.0 | | | | | |
| Sulfurized fatty Ester (Additin RC 2515) | | | | | | | | | | 10.0 | 10.0 |
| Sulfurized Fatty Ester (Additin RC 2526) | | | | | | | | | | 5.0 | 5.0 |
| Four-Ball EP Weld Point | 800+ | 800 | 800 | 800+ | 800 | 800 | 620 | 620 | 800 | 800+ | 800 |
| Four-Ball EP LWI | 239 | 184 | 221 | 154 | 117 | 119 | 143 | 130 | 203 | 164 | 153 |

Containing 7.5% glyceryl monooleate
Containing 5% glyceryl monooleate
Containing 5% lard oil Lubrizol 5340L, by Lubrizol Corporation is a sulfurized hydrocarbon. Paraffinic mineral oil (200 SUS) by Sun Oil Company is a mineral oil consisting mostly of alkyl hydrocarbons. It is generically referred to as "mineral oil." Soybean Oil (IV 120) is a commercial product with iodine number of 120, supplied by Cargill.

Base Fluid Performance and Improvements Due to EP Additives

Various base fluids have inadequate performance as metalworking fluids on their own. Table 3 shows the load wear index and welding point for soybean and canola oils, compared with oxidized soybean oil, methyl soyate, and mineral oil.

TABLE 3

BASE FLUIDS

| FLUID | Load Wear Index | Welding Point |
|---|---|---|
| Methyl Oleate 130 | 10.4 | 126 |
| Mineral Oil | 14 | 126 |
| Canola Oil | 15.5 | 100 |
| Soybean Oil | 19.1 | 100 |
| Oxidized Soybean Oil | 92.3 | 160 |

As shown in Table 4, adding EP additive D77 improves the performance dramatically. At 5% D77, soybean oil and canola oil both have LWI greater than 130, and soybean oil has a welding point of 620. While inferior to methyl soyate, this product is less expensive and its performance is superior to mineral oil. Also, while canola oil can reach the 400 or 800 kg level for welding point, it requires higher concentrations of the relatively expensive EP additive. Oxidized soybean oil exhibits the best initial load wear index performance. However, it is unstable and tends to polymerize to rubber-like material on standing and so is unacceptable.

TABLE 4

PERFORMANCE OF BASE FLUIDS WITH PHOSPHOROUS-BASED EP ADDITIVE D77

| Fluid | 3% | 5% | 10% | 15% |
|---|---|---|---|---|
| LOAD WEAR INDEX | | | | |
| Soybean Oil | 98 | 195 | 226 | 221 |
| Canola Oil | 120 | 154 | 189 | 198 |
| Oxidized Soybean Oil | 122 | 216 | 187 | 249 |
| Methyl Soyate | 106 | 167 | 237 | 393 |
| Mineral Oil | 62 | 115 | 178 | 184 |
| WELDING POINT | | | | |
| Soybean Oil | 315 | 620 | 800 | 800 |
| Canola Oil | 250 | 315 | 400 | 800 |
| Oxidized Soybean Oil | 250 | 400 | 620 | 800 |
| Methyl Soyate | 800 | 800 | >800 | >800 |
| Mineral Oil | 250 | 400 | 620 | 800 |

Specificity of EP Additives for Soybean Oil

Surprisingly, a phosporous-based EP additive is superior to other polar non-chlorine additives, and far superior to chloroparaffin, in a soybean oil base fluid. As shown in Table 5, Elco 670, an organophosphite with high hydrocarbon chain length, was inferior at a 3% concentration and required higher concentration (15%) to provide the best combination of LWI and welding point. With the amine phosphate EP additive D77, the LWI and weld point were better than the toxic chloroparaffin additive at all concentrations, and performance met the functional test of exceeding a LWI of 40 and a weld point of 315 at 3% and improved to superior performance at 5% and 10%, with weld point of 800. Hence, formulations based on the phosphorous based EP additive are more adaptable and useful for preparing a range of formulations in terms of performance and cost (the EP additive component costs more than the base oil).

TABLE 5

| EP ADDITIVES IN SOYBEAN OIL | | | | |
|---|---|---|---|---|
| Additive | 3% | 5% | 10% | 15% |
| LOAD WEAR INDEX | | | | |
| Elco 670 | 139 | 193 | 141 | 203 |
| Chloroparaffin | 23 | 49 | 115 | 115 |
| D77 | 98 | 195 | 226 | 221 |
| WELD POINT | | | | |
| Elco 670 | 250 | 400 | 400 | 800 |
| Chloroparaffin | 160 | 315 | 620 | 620 |
| D77 | 315 | 620 | 800 | 800 |

The results suggest that a combination of a vegetable oil and a polar non-chlorine extreme pressure additive may operate under a potential mechanism not intended to limit the scope of the invention. FIG. 1 illustrates comparative properties of soybean oil (bp>300° C., MW ~900), methyl soyate (bp 200-300° C., MW ~300), and mineral oil (bp 300-500° C., MW 225-700+). As shown in FIG. 1, the polar groups of the soybean oil triglycerides 2 interact with the metal surface 1 to provide some lubrication. The polar heads of the methyl ester 3 likewise interact with the metal surface so the non-polar hydrocarbon chains line up way from the surface. Mineral oil 4 does not interact or line up in such a fashion.

Figure 2:
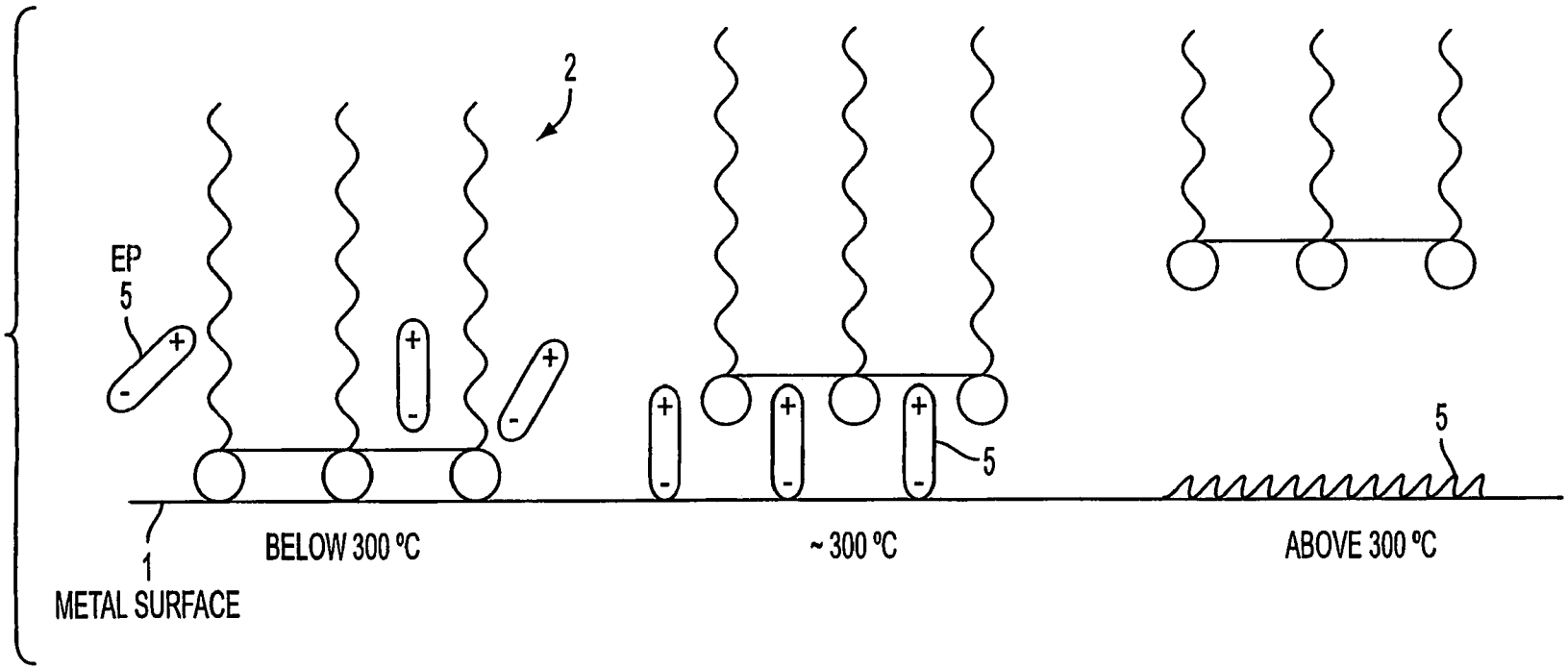
FIG. 2 depicts aspects of a hypothetical mechanism for the performance of the inventive metalworking fluids.

FIG. 2 depicts aspects of a hypothetical mechanism for the performance of the inventive metalworking fluids. As shown in FIG. 2, below 300° C. the vegetable oil triglyceride molecules 2 line up with polar groups interacting with the metal surface 1 as shown, with the polar EP additive 5 interspersed around and between the triglyceride molecules, near or away from the metal surface 1. At about 300° C. the triglyceride molecules begin to boil away, the EP molecules 5 therefore becoming concentrated at the metal surface. Above 300° C., the triglyceride molecules 2 are removed, and the EP additive is activated and reacts with the metal surface, forming protective compounds at the surface 6 such as (for phosphorous-based EP additives) phosphides, phosphates, etc.

In another embodiment representing the soluble heavy-duty formulation, the methyl soyate and soybean oil were incorporated into the heavy-duty soluble oil formulation at a 5% concentration to determine its influence on the performance of the fluid. Table 6 lists the following three references: a chlorinated paraffin based formulation with mineral oil (Example 45), a chlorinated based formulation with mineral oil and soybean oil (Example 46) and a chlorinated paraffin based formulation with mineral oil and methyl soyate (Example 47).

TABLE 6

| Heavy Duty Soluble Oil Formulations | | | |
|---|---|---|---|
| Component | Example 45 | Example 46 | Example 47 |
| 100 SUS Naphthenic | 55.1% | 48.9% | 48.9% |
| Petromix #9 | 20.4% | 20.1% | 20.1% |
| Chlorinated Paraffin | 20.4% | 20.0% | 20.0% |
| Triazine | 1.6% | 3.0% | 3.0% |
| Tall Oil Fatty Acid | 2.5% | 3.0% | 3.0% |
| Soybean Oil | — | 5.0% | — |
| Methyl Soyate | — | — | 5.0% |
| pH, 5% Solution | 9.6 | 9.3 | 9.2 |

Falex Pin and Vee Block and Cast Iron Chip Test results for these three fluids are shown in Table 7. The fluids were diluted to 5% in tap water for the Falex procedure and to 4% in 100 ppm for the Cast Iron Chip Test.

TABLE 7

| Falex Pin and Vee Block and Cast Iron Chip Test Results | | |
|---|---|---|
| | Falex Pin and Vee Block Results (failure load in lbs) | Cast Iron Chip Test Results (% of the surface covered with iron) |
| Example 45 | 4,200 | 3% |
| Example 46 | 4,250 | 2% |
| Example 47 | 4,100 | 2% |

Usage of chlorinated paraffins in soluble oils leads to a dramatic improvement in failure load in the Falex pin and Vee Block Test. Employment of soybean oil and methyl soyate in the heavy-duty formulation does not produce any change in the Falex performance. Both soybean-based products do not have a negative impact on the cast iron chip test results.

Consistent with the goals of the invention, a second approach was taken to develop a more environmentally friendly, metalworking fluid utilizing a chlorine free, extreme pressure additive (i.e. Desilube 77) in place of chlorinated paraffin. Three mineral oil based fluids were developed as part of this phase of the project. A control fluid formulated just with Desilube 77 (Example 48) and blends prepared with soybean oil (Example 49) and methyl soyate (Example 50). The three formulations are shown in Table 8.

TABLE 8

| Chlorine Free, Heavy Duty Soluble Oil Formulations | | | |
|---|---|---|---|
| Component | Example 48 | Example 49 | Example 50 |
| 100 SUS Naphthenic Oil | 42.7% | 26.8% | 25.0% |
| Petromix #9 | 10.2% | 10.8% | 10.0% |
| Soybean Oil | — | 9.1% | — |
| Methyl Soyate | — | — | 8.0% |
| Desilube 77 | 3.9% | 5.2% | 4.0% |
| Triethanolamine | 5.9% | 5.6% | 5.0% |
| Glycerol Monooleate | 9.4% | 10.4% | 4.0% |
| Triazine | 2.3% | 3.5% | 4.0% |
| 45% Potassium Hydroxide | 2.3% | 3.5% | 4.0% |
| Westvaco M 28B | 5.9% | 10.0% | 9.0% |
| Tween 80 | 7.4% | 6.1% | 2.0% |
| Gateway CP-105 | 10.0% | 10.8% | 10.0% |
| Igepal CO-530 | — | — | 10.0% |
| Propylene Glycol | — | — | 6.0% |
| pH, 5% in Water | 8.9 | 9.0 | 9.2 |

100 SUS Naphthenic Oil, Petromix #9 by Crompton Corporation, is a petroleum sulfonate based emulsifier (an anionic emulsifier). Triazine is hexahydro-1,3,5 tris (2-hydroxyethyl)-8-triazine. Westvaco M 28B is a tall oil fatty acid (anionic soap). Tween 80 (nonionic surfactant) is POE (2) sorbitan monooleate, Gateway CP-105, by Gateway Additives, is a corrosion inhibitor. Igepal CO-530 (nonionic surfactant), by Rhodia Corporation, is a nonyl phenol 6-mole ethoxylate.

Additional components were needed to stabilize these formulations. Petromix #9, potassium salt of Westvaco M-28B, glycerol monooleate, Tween 80 and Igepal CO-530, and a coupling agent (propylene glycol) were utilized in the formulation work. Gateway CP-105 was also utilized to improve the corrosion protection of the fluids.

Data produced from the evaluation of the lubricity and corrosion inhibition characteristics of Example 48 through Example 50 are shown in Table 9. All fluids were diluted to 5% in tap water for the Falex Pin and Vee Block procedure and to 4% in 100 ppm water for the Cast Iron Chip Test.

TABLE 9

Falex Pin and Vee Block and Cast Iron Chip Test Results

| | Falex Pin and Vee Block Results (failure load in lbs) | Cast Iron Chip Test Results (% of the surface covered with rust) |
|---|---|---|
| Example 48 | 4,300 lbs | 4% |
| Example 49 | 4,300 lbs | 2% |
| Example 50 | 4,300 lbs | 0% |

The chlorine free, environmentally friendly fluids generate comparable Falex Pin and Vee Block and Cast Iron Chip Test results as compared to Examples 45-47. These results mean that Examples 49 and 50 are quite suitable for use in performance trials as alternatives to the traditional chlorinated paraffin-based, heavy-duty soluble oils. Thus, soybean oil and other vegetable oils can be used as a suitable substitute for some or all of the base fluid.

The embodiments illustrated and discussed in this specification are intended only to teach those skilled in the art the best way known to the inventors to make and use the invention. Nothing in this specification should be considered as limiting the scope of the present invention. The above-described embodiments of the invention may be modified or varied, and elements added or omitted, without departing from the invention, as appreciated by those skilled in the art in light of the above teachings. It is therefore to be understood that, within the scope of the claims and their equivalents, the invention may be practiced otherwise than as specifically described.

We claim:

1. A composition comprising:

at least about 5% a soybean oil, and from about 3% to about 15% phosphorous-based polar non-chlorine extreme pressure additive, the components being compatible, and the composition having a boiling point of at least about 200° C. and effectively lubricating metal parts and imparting a load wear index of at least about 98 in a four ball test and a weld point of at least about 315 kg in a four ball test, wherein the phosphorous-based polar non-chlorine extreme pressure additive is soluble in the soybean oil.

2. The composition of claim 1, wherein the extreme pressure additive is an amine salt of phosphoric acid.

3. The composition of claim 1, wherein the extreme pressure additive is an alkylamine or alkanolamine salt of phosphoric acid.

4. The composition of claim 1, wherein the extreme pressure additive is an amine phosphate.

5. The composition of claim 1, wherein the extreme pressure additive is in a concentration of from about 3% to about 5%.

6. The composition of claim 1, wherein the extreme pressure additive has two to five carbons.

7. The composition of claim 1, the composition containing no mineral oil or added water.

8. The composition of claim 1, wherein the composition has a four ball weld point of at least about 500 kg.

9. The composition of claim 1, wherein the composition provides a four-ball weld point of at least about 620 kg.

10. The composition of claim 1, wherein the composition imparts a four-ball EP weld point of at least about 800 kg.

11. The composition of claim 1, wherein the composition has a Falex EP (ASTM D3233) fail load of at least about 4500 lbs.

12. The composition of claim 1, wherein the polar extreme pressure additive is selected from the group consisting of amine phosphates, alkylamine or alkanolamine salts of phosphoric acid, butylamine phosphates, long chain alkyl amine phosphates, organophosphites, propanolamine phosphates, hydrocarbon amine phosphates, triethanol, monoethanol, dibutyl, dimethyl, or monoisopropanol amine phosphates, thioesters, amides of phosphorous containing acids, and combinations.

13. The composition of claim 1, wherein the polar non-chlorine extreme pressure additive is selected from the group consisting of organic amine salts of phosphoric acids, organic amine salts of fatty acids, phosphate esters, and organophosphites.

14. The composition of claim 1, wherein the composition further comprises a thickener.

15. The composition of claim 14, wherein the viscosity at 40° C. is at least about 30 cSt.

16. The composition of claim 14, wherein the thickener is selected from the group consisting of blown seed oils, blown fats, telemers derived from triglycerides, high molecular weight complex esters, polymeric ester, blown castor oil, polyalkylmethacrylates, polymethacrylate copolymers, styrene butadiene rubber, ester-styrene copolymers, polyisobutylene, ethylene-propylene copolymers and combinations.

17. The composition of claim 14, wherein the thickener is selected from the group consisting of blown castor oil, a complex ester, a polyalkylmethacrylate, polymethylmethacrylate, and a styrene copolymer.

18. The composition of claim 14, wherein the thickener permits the composition to have residency time as expressed by kinematic viscosity of at least about 100 cSt at 40° C., film strength as measured by four-ball initial seizure load of at least about 120 kg, and compatibility between the soybean oil and the extreme pressure additive.

19. The composition of claim 1, wherein the composition further comprises a stabilizing coupling agent and/or surfactant.

20. The composition of claim 19, wherein the coupling agent and/or surfactant is selected from the group consisting of polyethylene glycol esters, glyceryl oleates, sorbitan oleates, fatty alkanol amides and combinations.

21. The composition of claim 1, wherein the composition further comprises an antioxidant and/or dispersant.

22. The composition of claim 21, wherein the antioxidant and/or dispersant is selected from the group consisting of hindered phenols, aromatic amines, succinimides and combinations.

23. The composition of claim 21, wherein the antioxidant and/or dispersant is selected from the group consisting of a high molecular weight antioxidant and an octylated/butylated diphenylamine.

24. The composition of claim 1, comprising from about 20% to about 95% soybean oil, from about 3% to about 15% extreme pressure additive, up to about 50% thickener, up to about 10% coupling agent and/or surfactant, and up to about 25% antioxidant and/or dispersant.

25. The composition of claim 1, the composition being a soluble oil concentrate without added water.

26. The composition of claim 1, comprising from about 5% to about 90% soybean oil, from about 3% to about 15% extreme pressure additive, up to about 10% coupling agents, from about 5% to about 40% corrosion inhibitors, up to about 10% biocides, from about 10% to about 50% emulsifiers, up to about 6% antioxidants and up to about 5% defoamers.

27. A method of making a working strength soluble oil composition according to claim 1, comprising (a) combining a soybean oil with an extreme pressure additive to form a soluble oil concentrate without adding water, (b) diluting the concentrate to working strength with water.

28. The method of claim 27, further comprising adding a coupling agent increasing stability, a corrosion inhibitor, an emulsifier, and/or an anti-bacterial and/or anti-fungal compound effective to reduce bacterial and fungal formation.

29. The composition according to claim 1, comprising at least about 50% water and from about 5% to about 50% soybean oil, and from about 5% to about 15% extreme pressure additive.

30. The composition of claim 1, wherein the composition has a metalworking performance at least equivalent to a mineral oil based chlorinated paraffin metalworking fluid.

31. The composition of claim 1, wherein the concentration of extreme pressure additive is within a range of from about 3% to about 10%.

32. The composition of claim 1, wherein the phosphorous-based polar non-chlorine extreme pressure additive is an organic compound.

33. The composition of claim 1, wherein the phosphorous-based polar non-chlorine extreme pressure additive is a compound whose atoms are selected from the group consisting of phosphorous, nitrogen, hydrogen, carbon, and oxygen and combinations.

34. The composition of claim 1, wherein the phosphorous-based polar non-chlorine extreme pressure additive is selected from the group consisting of an amine salt of phosphoric acid, an organic salt of phosphoric acid, an amine phosphate, an organic phosphate, an organophosphite, and an amide of a phosphorous containing acid.

35. The composition of claim 1, wherein the phosphorous-based polar non-chlorine extreme pressure additive does not include alkali metal.

36. The composition of claim 1, wherein the phosphorous-based polar non-chlorine extreme pressure additive does not include metal.

37. The composition of claim 19, wherein the coupling agent and/or surfactant is selected from the group consisting of propylene glycol and glycerol monooleate.

38. The method of claim 27, wherein water is added in the diluting step to form a working strength soluble oil composition comprising at least about 50% water.

39. The method of claim 27, wherein water is added in the diluting step to form a working strength soluble oil composition comprising at least about 75% water.

40. The method of claim 27, wherein water is added in the diluting step to form a working strength soluble oil composition comprising at least about 95% water.

* * * * *